US007137156B2

(12) United States Patent
Yang

(10) Patent No.: US 7,137,156 B2
(45) Date of Patent: Nov. 21, 2006

(54) PORTABLE LAVATORY

(75) Inventor: Byung Joon Yang, Yongin-Si (KR)

(73) Assignee: Jinsung Mobile Co., Ltd., Gwangju-Si (KR)

( * ) Notice: Subject to any disclaimer, the term of this patent is extended or adjusted under 35 U.S.C. 154(b) by 0 days.

(21) Appl. No.: 10/564,047

(22) PCT Filed: May 7, 2004

(86) PCT No.: PCT/KR2004/001056

§ 371 (c)(1),
(2), (4) Date: Jan. 9, 2006

(87) PCT Pub. No.: WO2005/004691

PCT Pub. Date: Jan. 20, 2005

(65) Prior Publication Data

US 2006/0185075 A1 Aug. 24, 2006

(30) Foreign Application Priority Data

Jul. 10, 2003 (KR) ..... 10-2003-0046940

(51) Int. Cl.
*A47K 4/00* (2006.01)
*E03C 1/01* (2006.01)

(52) U.S. Cl. ..... 4/664; 4/476; 4/663; 4/354; 4/596; 4/321

(58) Field of Classification Search ..... 4/662–664, 4/354, 353, 900, 596, 597, 321, 332, 476, 4/599; 141/65, 59; 184/1.5
See application file for complete search history.

(56) References Cited

U.S. PATENT DOCUMENTS 3,842,445 A * 10/1974 Jones ..... 4/321
4,707,868 A * 11/1987 Hennessy ..... 4/362
4,868,936 A * 9/1989 Crocoli ..... 4/663
4,935,971 A * 6/1990 Dunn et al. ..... 4/559
5,005,226 A * 4/1991 Basile et al. ..... 4/354
5,318,080 A * 6/1994 Viken ..... 141/98
5,548,856 A 8/1996 Julian
5,596,772 A * 1/1997 Schon ..... 4/361
6,178,566 B1 1/2001 Yagi
6,253,805 B1 * 7/2001 Erwin et al. ..... 141/59
6,393,775 B1 * 5/2002 Staschik ..... 52/79.1

(Continued)

FOREIGN PATENT DOCUMENTS

JP 04-176417 6/1992

(Continued)

*Primary Examiner*—Khoa D. Huynh
(74) *Attorney, Agent, or Firm*—IPLA P.A.; James E. Bame

(57) ABSTRACT

A portable lavatory, which is easily loaded into a freight box of a truck and is maintained in a stable loaded state in the freight box during transportation, is disclosed. In the portable lavatory (10), the capacities of both a fresh water tank (20) and a foul water tank (30) of a tank unit (12) are altered in inverse proportion to each other. The tank unit (12), integrated with a lower end of a lavatory facility unit (11), has a width and length shorter than those of the lavatory facility unit, thus being stepped inward from the lower end of the lavatory facility unit. The fresh water tank (20) and the foul water tank (30) are assembled with each other at flanged open ends thereof into a single structure, with a variable tank (40) provided in a junction part between the two tanks.

2 Claims, 7 Drawing Sheets

U.S. PATENT DOCUMENTS

| | | | | |
|---|---|---|---|---|
| 6,507,958 | B1 * | 1/2003 | Tagg | 4/321 |
| 6,721,967 | B1 * | 4/2004 | Braxton | 4/664 |
| 2003/0037837 | A1 * | 2/2003 | Erwin et al. | 141/65 |
| 2003/0121093 | A1 * | 7/2003 | Braxton | 4/476 |
| 2004/0187201 | A1 * | 9/2004 | Whitehead | 4/354 |
| 2005/0241055 | A1 * | 11/2005 | Mullett et al. | 4/476 |

FOREIGN PATENT DOCUMENTS

| | | |
|---|---|---|
| KR | 20-0294918 | 10/2002 |

* cited by examiner

PORTABLE LAVATORY

TECHNICAL FIELD

The present invention relates, in general, to portable lavatories and, more particularly, to a portable lavatory which is easily loaded into a freight box of a truck and is maintained in a stable loaded state in the freight box while the portable lavatory is transported to a desired place by the truck, and of which the capacities of both a fresh water tank and a foul water tank of a tank unit constituting a lower part of the portable lavatory are altered in inverse proportion to each other. The portable lavatory of the present invention is constructed in that the tank unit, integrated with a lower end of a lavatory facility unit to constitute the lower part of the portable lavatory, has a width and length shorter than those of the lavatory facility unit by predetermined distances, thus being stepped inward from the lower end of the lavatory facility unit, and both the fresh water tank and the foul water tank each comprise a tank body opened at an end thereof and are assembled with each other at the open ends thereof into a single structure, with a variable tank provided in a junction part between the fresh water tank and the foul water tank.

BACKGROUND ART

The construction of a conventional portable lavatory will be described herein below, with reference to FIGS. 1 and 2 that show a portable lavatory according to an embodiment of the present invention.

As shown in FIGS. 1 and 2, a portable lavatory typically comprises a lavatory facility unit 11 and a tank unit 12. The lavatory facility unit 11, which is typically equipped therein with a toilet, a washbowl, etc., constitutes an upper part of the portable lavatory. The tank unit 12, which constitutes a lower part of the portable lavatory, feeds water from a fresh water tank thereof to the lavatory facility unit 11, and stores in a foul water tank thereof the foul water drained from the lavatory facility unit 11. To allow the portable lavatory to be used for a lengthy period after every filling of water in the fresh water tank and every emptying of the foul water tank the portable lavatory may be designed to contain a large quantity of water in the fresh water tank and a large quantity of foul water in the foul water tank. However, the above-mentioned design of the portable lavatory must be accompanied by an increase in each of the water containing capacity the tank unit 12 and the size of the portable lavatory.

To transport portable lavatories of various sizes to desired places, a variety of trucks may be used. To move a large-sized portable lavatory from a place to another place, a large-sized truck or a truck tractor with a trailer may be used. However in the case of a medium- or small-sized portable lavatory, a medium-sized truck may be used to transport the portable lavatory to a desired place.

In conventional portable lavatories, the length and width of the lavatory facility unit are equal to those of the tank unit, so that the sidewalls of both the lavatory facility unit and the tank unit are integrally continued to form a flat outer surface of the sidewalls. Thus, a conventional small-sized portable lavatory may be safely transported to a desired place while the portable lavatory is stably loaded into an open freight box 2 of a truck 1, which is defined on a bed 3 of the truck 1 by one front panel, two side gates 4 and one tailgate 5 that respectively stand along the front, side and rear edges of the bed 3. However, the small-sized portable lavatory provides only a small-capacity tank unit 12 having both a small fresh water tank and a small foul water tank, so that a manager of the small-sized portable lavatory installed on a place must frequently refill the fresh water tank with water and frequently empty the foul water tank.

A conventional large-sized portable lavatory may not be loaded in the freight box 2 of the truck 1 of which the two side gates 4 and the one tailgate 5 stand along the edges of the bed 3. Therefore, the two side gates 4 and the one tailgate 5 of the freight box 2 must be opened prior to loading the large-sized portable lavatory onto the bed 3. In the above state, the opened side gates 4 and the opened tailgate 5 may not be fastened to any part of the truck 1, so that the opened side gates 4 and the opened tailgate 5 may clatter during a transportation of the portable lavatory. Furthermore, the width of the large-sized portable lavatory exceeds the width of the bed 3, so that both side parts of the portable lavatory protrude outward to substantial lengths from both sides of the bed 3. In the above state, it is not easy to firmly or stably tie the portable lavatory to the truck 1 using a rope, due to the protruding side parts of the portable lavatory, so that the large-sized portable lavatory loaded on the bed 3 is not stable, thus sometimes unexpectedly moving on the bed 3 to be dropped from the bed 3 onto a road or the ground around the road during the transportation of the portable lavatory. Furthermore, the protruding side parts of the large-sized portable lavatory loaded on the bed 3 may collide on materials or persons placed or walking along roadsides or may strike against another vehicle passing by the truck 1 while the truck 1 runs along the road to transport the portable lavatory to a desired place. Thus, the protruding side parts of the large-sized portable lavatory loaded on the bed 3 may cause safety hazards during the transportation of the portable lavatory.

Furthermore, the tank unit 12, which constitutes the lower part of the conventional portable lavatory, is divided into the fresh water tank and the foul water tank by a fixed partition wall that is fixedly installed in the tank unit 12. Thus, the fresh water tank and the foul water tank respectively have fixed capacities. Thus, when the fresh water tank is in an almost full state by refilling the fresh water tank, the foul water tank is in an almost empty state. On the contrary, when the foul water tank is in an almost full state, the fresh water tank is in an almost empty state. Thus, the conventional portable lavatory is problematic in that the capacity of tank unit 12 of the portable lavatory is not effectively used.

DISCLOSURE OF THE INVENTION

Accordingly, the present invention has been made keeping in mind the above problems occurring in the prior art and an object of the present invention is to provide a portable lavatory, which is easily loaded into a freight box of a truck and which is thus constructed in that a tank unit, integrated with a lower end of a lavatory facility unit to constitute a lower part of the portable lavatory, has a width and length shorter than those of the lavatory facility unit by predetermined distances, thus being stepped inward from the lower end of the lavatory facility unit, and in which both a fresh water tank and a foul water tank of the tank unit each comprise a tank body opened at an end thereof and are assembled with each other at the open ends thereof into a single structure, with a variable tank provided in a junction part between the fresh water tank and the foul water tank. Another object of the present invention is to provide a portable lavatory, which is constructed to provide a step around the lower end of the lavatory facility unit and define a space around an outer surface of the tank unit, and which is thus easily and stably loaded into the freight box of a truck such that the tank unit is inserted into the freight box while the lower end of the lavatory facility unit is seated along upper ends of both side gates and a tailgate of the freight box.

Yet another object of the present invention is to provide a portable lavatory, in which a variable tank is provided in a junction part between the fresh water tank and the foul water tank of the tank unit, so that, when water is supplied into the fresh water tank, the variable tank moves toward the foul water tank to increase the capacity of the fresh water tank and allows the fresh water tank to contain a large quantity of water therein, and, as the water of the fresh water tank is gradually consumed and foul water is generated from the lavatory facility unit, the variable tank gradually moves toward the fresh water tank to gradually increase the capacity of the foul water tank and allow the foul water tank to contain a large quantity of foul water, and which is thus used for a lengthy period after every filling of water in the fresh water tank.

Still another object of the present invention is to provide a portable lavatory, which is loaded into a freight box of a truck such that the tank unit is inserted into the freight box while the lower end of the lavatory facility unit is seated along the upper ends of the side gates and the tailgate of the freight box, and which is thus maintained in a stable, firm and safe loaded state in the freight box without being fastened to the truck using a rope.

In order to accomplish the above object, the present invention provides a portable lavatory, comprising: a lavatory facility unit equipped therein with a toilet, a washbowl, etc., and having a door on a sidewall thereof, and a tank unit integrated with a lower end of the lavatory facility unit to constitute a lower part of the portable lavatory, the tank unit being constructed such that a width and length thereof are shorter than those of the lavatory facility unit by predetermined distances, thus providing a step around the lower end of the lavatory facility unit and defining a space around an outer surface of the tank unit, the tank unit comprising: a fresh water tank and a foul water tank each comprising a talk body which is opened at an end thereof and is tapered at the open end thereof to define a tapered part with a flange provided around the open end of the tapered part, the fresh water tank and the foul water tank being fastened to each other at the flanges thereof facing each other, thus being integrated into a single structure while achieving a predetermined sealing effect at a junction part between the flanges; and a variable tank provided in the junction part between the flanges such that the variable tank is interposed between the flanges to provide the predetermined sealing effect at the junction part.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CAMMING OUT THE INVENTION

Figure 1:
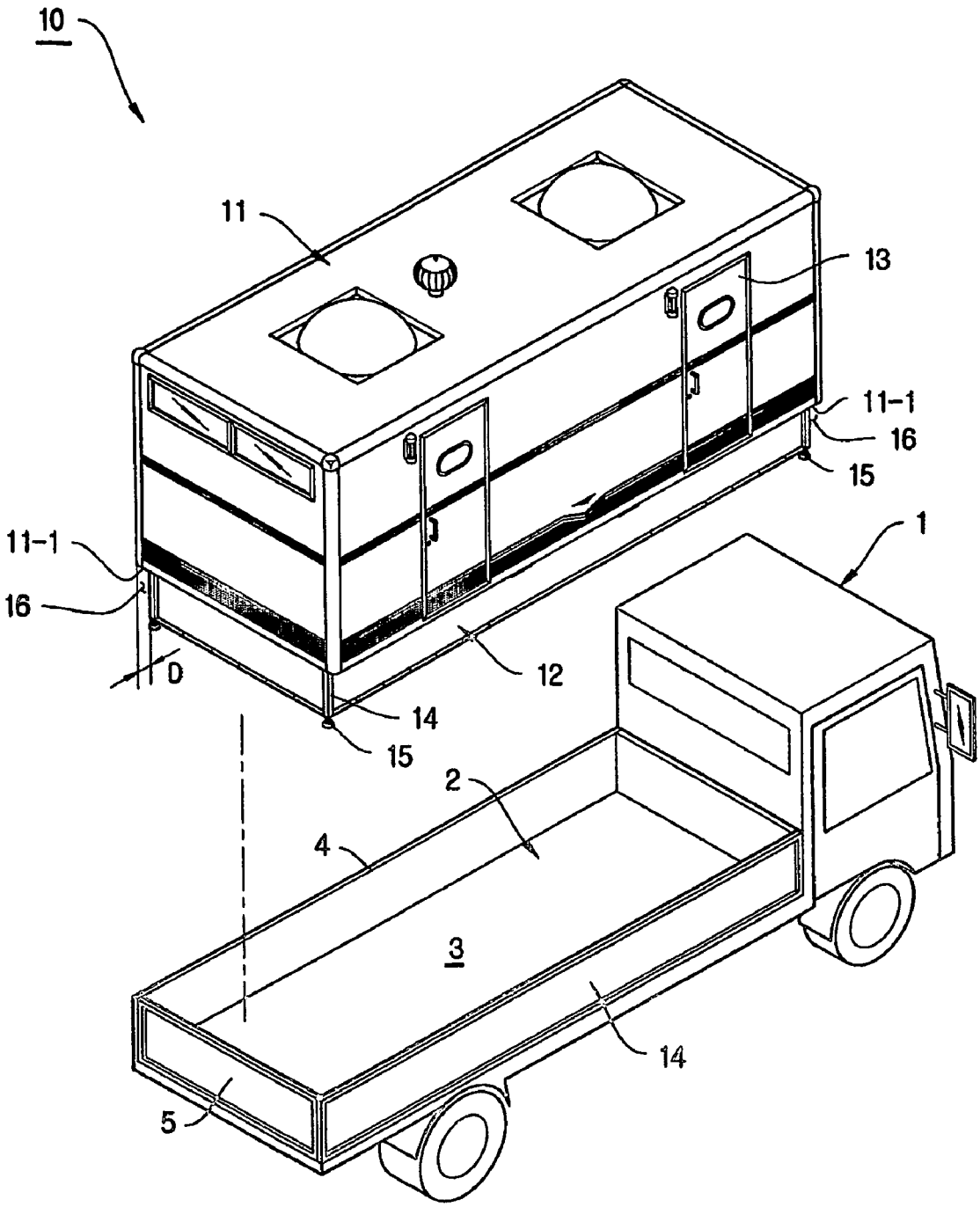
FIG. 1 is a perspective view showing a portable lavatory according to a preferred embodiment of the present invention, which is placed relative to a freight box of a truck.

Reference should now be made to the drawings, in which the same reference numerals are used throughout the different drawings to designate the same or similar components.

Figure 2:
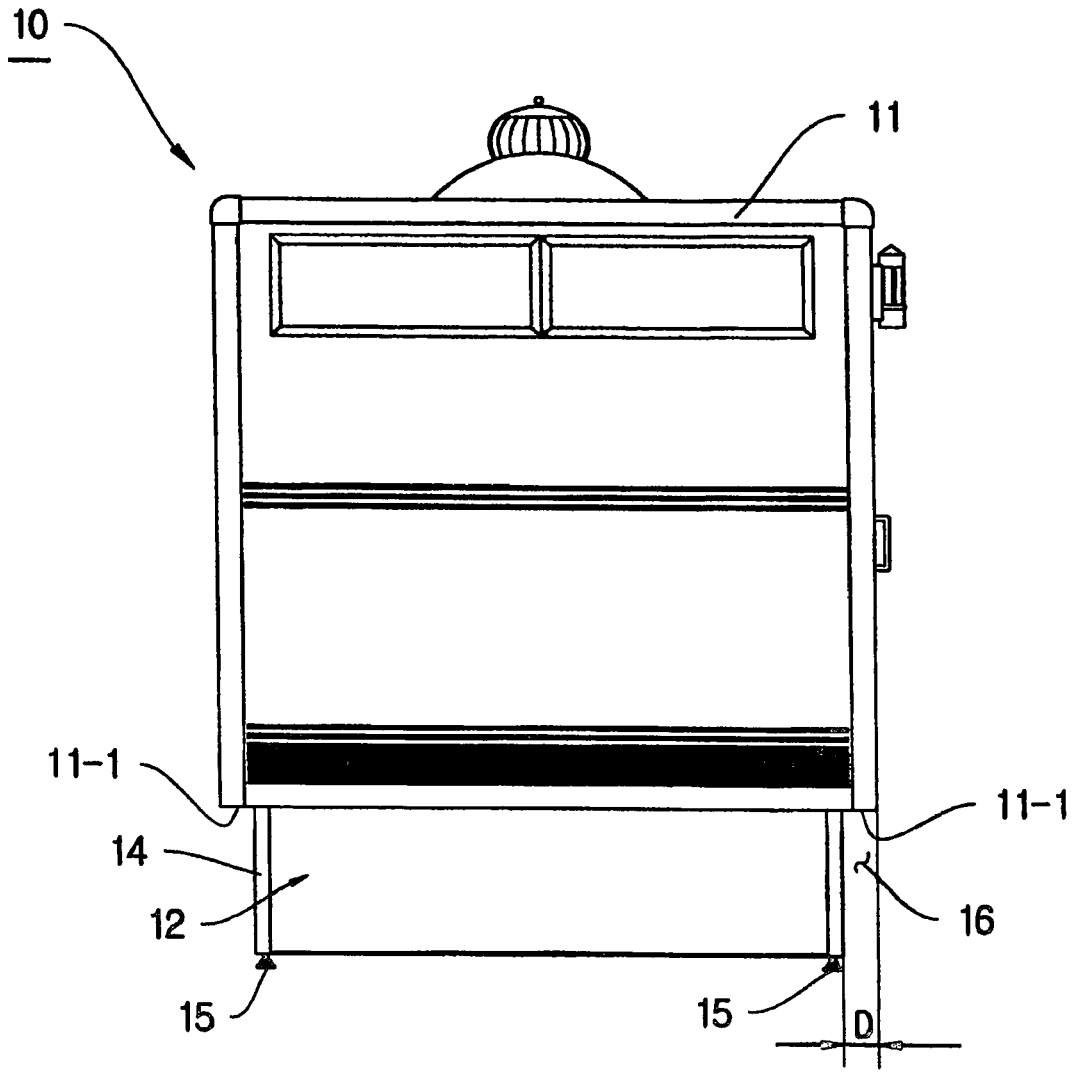
FIG. 2 is a side view of the portable lavatory of FIG. 1.
Figure 3A:
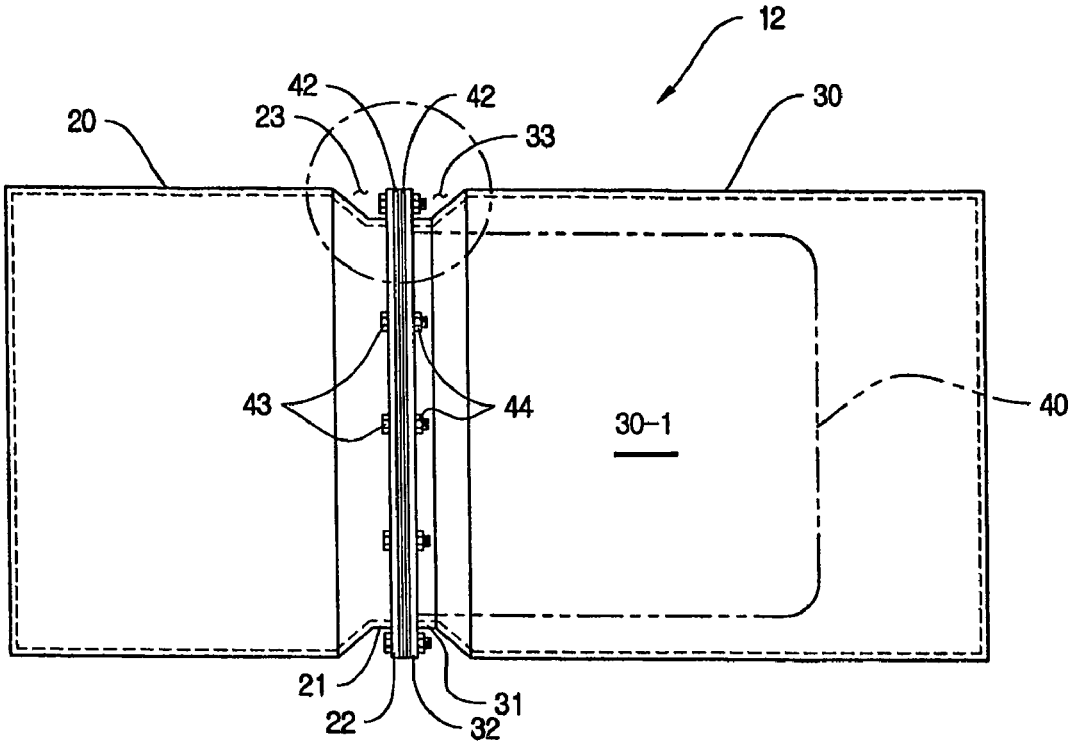
FIGS. 3*a* to 3*c* are sectional views showing the construction and operation of a tank unit constituting the portable lavatory of FIG. 1.
Figure 3B:
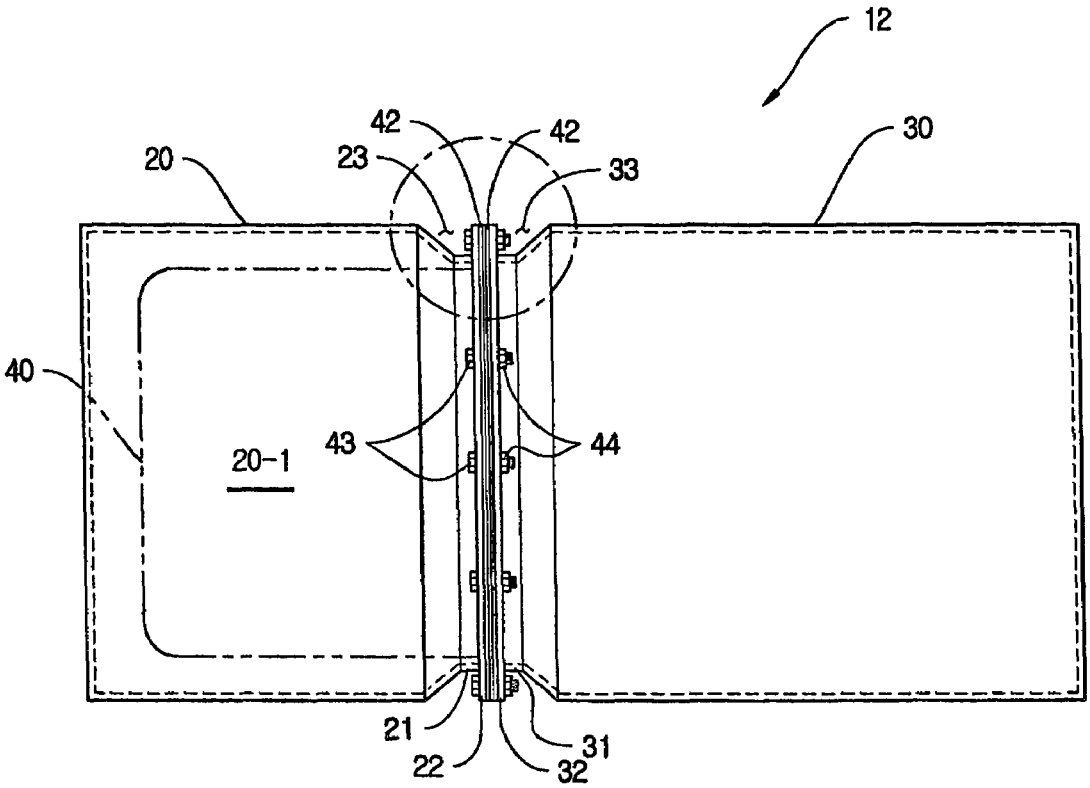
Figure 3C:
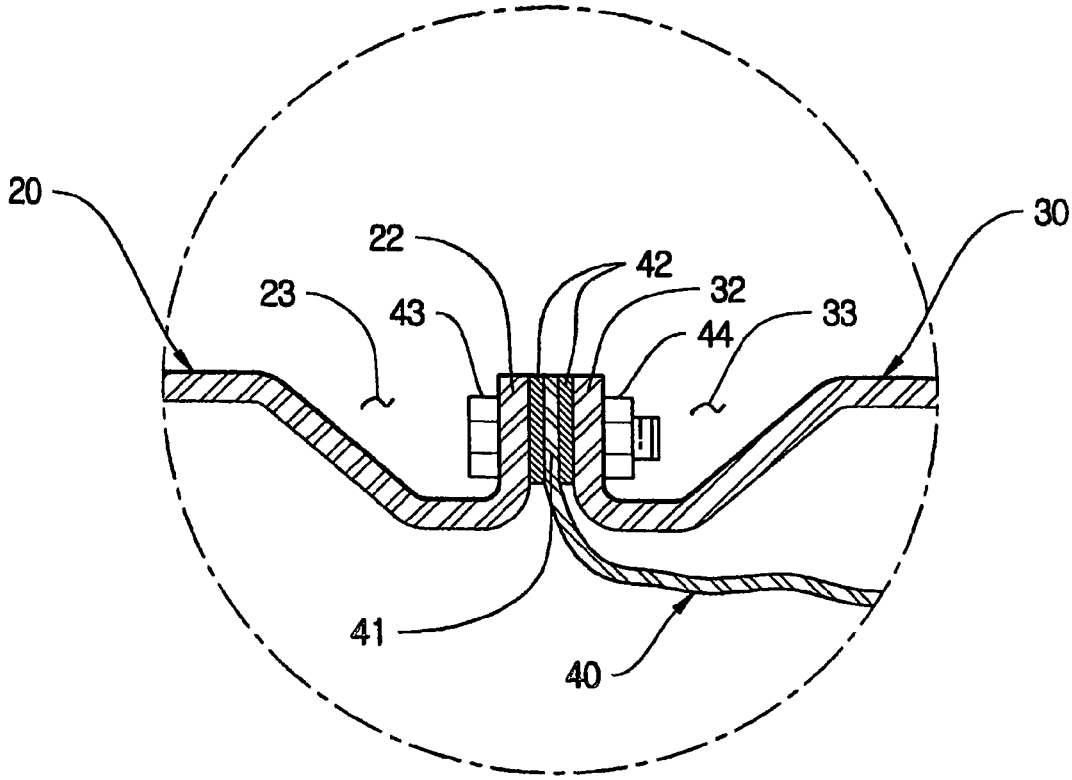
Figure 4A:
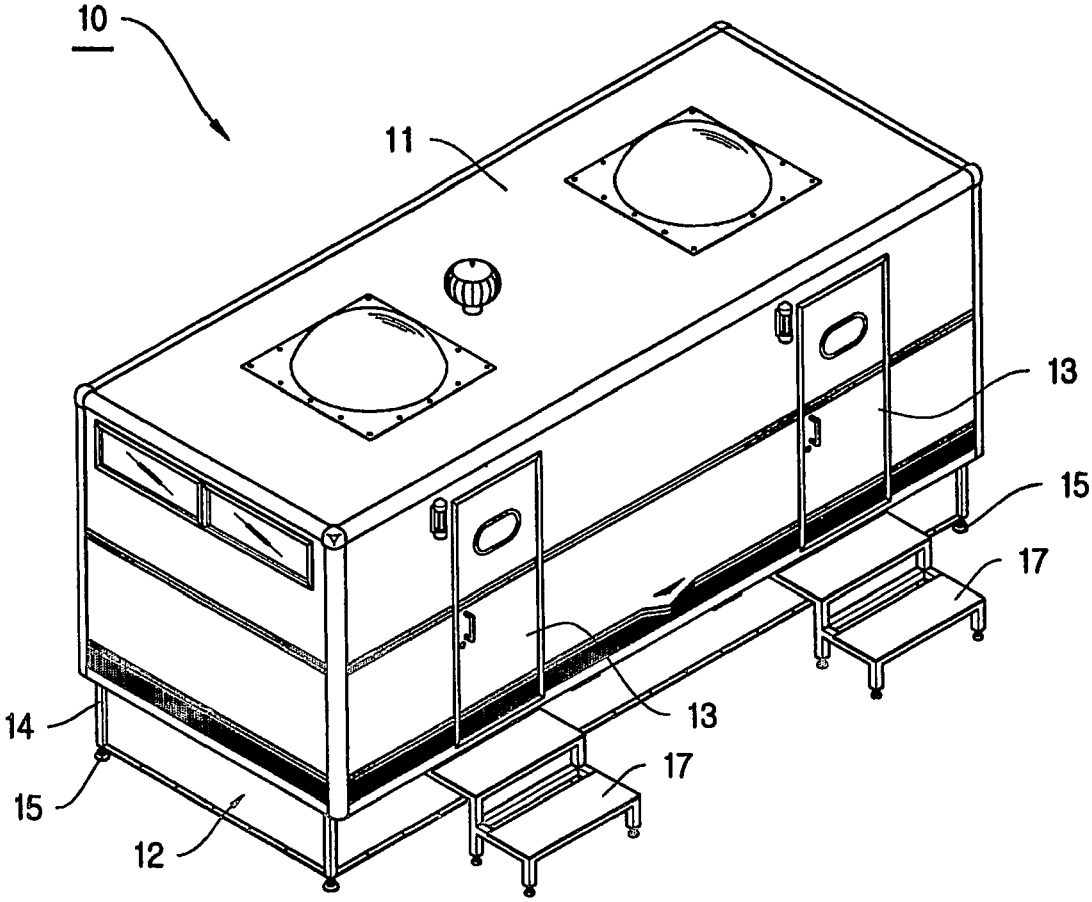
FIGS. 4*a* and 4*b* are a perspective view and a sectional view of the portable lavatory of FIG. 1, respectively, when the portable lavatory is installed on a place.
Figure 4B:
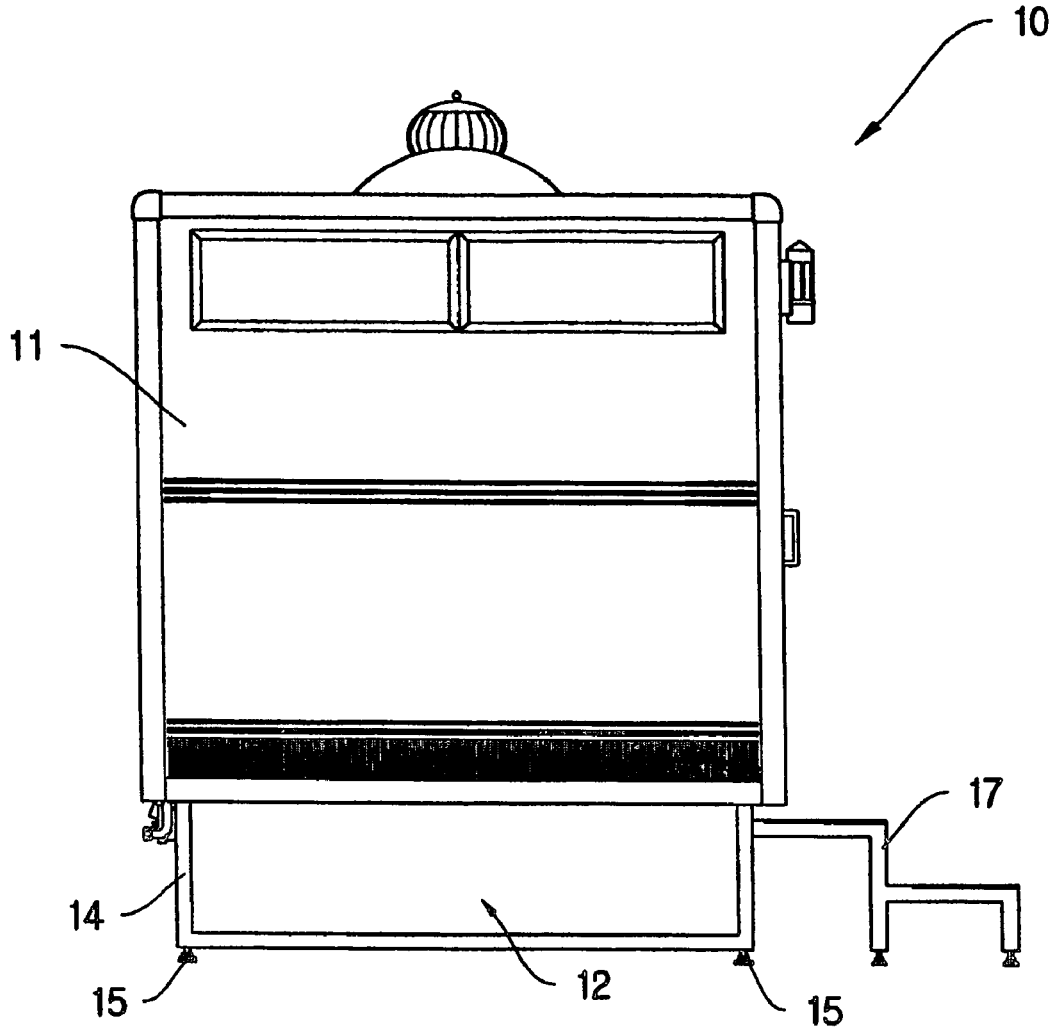

FIGS. 1 through 4*b* are views of a portable lavatory 10 according to a preferred embodiment of the present invention. Of the drawings, FIGS. 1 and 2 are a perspective view and a sectional view of the portable lavatory 10, respectively. FIGS. 3*a* to 3*c* are sectional views showing the construction and operation of a tank unit constituting the portable lavatory 10. FIGS. 4*a* and 4*b* are a perspective view and a sectional view of the portable lavatory 10 of FIG. 1, respectively, when the portable lavatory 10 is installed on a place.

As shown in FIGS. 1 and 2, the portable lavatory 10 of the present invention comprises a lavatory facility unit 11 and a tank unit 12. The lavatory facility unit 11, which is equipped therein with a toilet, a washbowl, etc., and has a door 13 on a sidewall thereof, constitutes an upper part of the portable lavatory 10. The tank unit 12 is integrated with a lower end of the lavatory facility unit 11 to constitute a lower part of the portable lavatory 10. In the portable lavatory 10, the tank unit 12 is constructed such that the width and length thereof are shorter than those of the lavatory facility unit 11 by predetermined distances D. Thus, a step 11-1 is provided around the lower end of the lavatory facility unit 11, while a space 16 is defined around the surface of the tank unit 12.

The construction of the tank unit 12 of which the width and length are shorter than those of the lavatory facility unit 11 by the predetermined distances D, will be described in detail herein below with reference to FIGS. 3*a* to 3*c*.

The tank unit 12 comprises a fresh water tank 20 and a foul water tank 30 each of which comprises a tank body opened at an end thereof. The fresh water tank 20 and the foul water tank 30 are tapered at the open ends thereof to respectively define tapered parts 21 and 31, with aflange 22 or 32 provided around the open end of each of the tapered parts 21 and 31 of the tanks 20 and 30. A space 23 or 33 is thus defined around each of the tapered parts 21 and 31 of the two tanks 20 and 30. To assemble the fresh water tank 20 and the foul water tank 30 into a single tank unit, the two tanks 20 and 30 are first arranged such that the flanges 22 and 32 thereof face each other. Thereafter, the two tanks 20 and 30 are fastened together at the flanges 22 and 32 using conventional nuts and bolts 44 and 43, with a desired sealing effect provided at a junction part between the two flanges 22 and 32.

In the above state, a variable tank 40 is provided in the junction part between the two flanges 22 and 32 of the fresh water tank 20 and the foul water tank 30 such that the variable tank 40 is interposed between the two flanges 22 and 32 of the two tanks 20 and 30 to provide the desired sealing effect at the junction part. In a detailed description, the variable tank 40 is placed at an edge thereof between the two flanges 22 and 32 of the two tanks 20 and 30, with two sealing plates 42 respectively interposed between both sides of the edge of the variable tank 40 and the two flanges 22 and 32. Thereafter, the two flanges 22 and 32 are fastened together along with both the edge of the variable tank 40 and the two sealing plates 42 using the nuts and bolts 44 and 43 that are arranged along the flanges 22 and 32 at regular intervals. Thus, the desired sealing effect at the junction part between the two flanges 22 and 32 of the tanks 20 and 30 is achieved.

When the two flanges 22 and 32 with both the edge of the variable tank 40 and the two sealing plates 42 are fastened together by the nuts and bolts 44 and 43 arranged along the flanges 22 and 32 at regular intervals, the spaces 23 and 33 defined around the tapered parts 21 and 31 of the two tanks 20 and 30 allow a worker to easily tighten the nuts and bolts 44 and 43.

The operation and effect of the above-mentioned portable lavatory is as follows.

In the portable lavatory 10 of the present invention, the tank unit 12 inter with the lower end of the lavatory facility unit 11 is constructed such that the width and length thereof are shorter than those of the lavatory facility unit 11 by the predetermined distances D. Thus, the step 11-1 is provided around the lower end of the lavatory facility unit 11, while the space 16 is defined around the outer surface of the tank unit 12. Therefore, when the portable lavatory 10 is loaded into a freight box 2 of a truck 1 using a crane (not shown) as shown in FIG. 1, the tank unit 12 of the lavatory 10 is inserted into the freight box 2 defined on a bed 3 by two side gates 4 and a tailgate 5, thus being seated on the bed 3. In the above state, the step 11-1 provided around the lower end of the lavatory facility unit 11 is seated along the upper ends of the side gates 4 and the tailgate 5 of the freight box 2. Furthermore, the outer surfaces of the sidewalls of the lavatory facility unit 11 protrude outward from the side gates 4 and the tailgate 5 of the freight box 2.

When the portable lavatory 10 is loaded into the freight box 2 of the truck 1 as described above, the tank unit 12 of the lavatory 10 is inserted into the freight box 2 defined on the bed 3 by the two side gates 4 and thetailgate 5, thus being seated on the bed 3, while the step 11-1 provided around the lower end of the lavatory facility unit 11 is seated along the upper ends of the side gates 4 and thetailgate 5 of the freight box 2. Thus, the portable lavatory 10 is stably and firmly loaded into the freight box 2 of the truck 1. Therefore, during a transportation of the portable lavatory 10 to a desired place, the lavatory 10 is maintained in a stable and firm loaded state in the freight box 2 without sliding or moving in the freight box 2. Furthermore, even through the outer surfaces of the sidewalls of the lavatory facility unit 11 protrude outward from the side gates 4 and the tailgate 5 of the freight box 2, the tank 12 is inserted into the freight box 2 of the truck 1 to be seated on the bed 3 and the step 11-1 of the lavatory facility unit 11 is seated along the upper ends of the side gates 4 and the tailgate 5 of the freight box 2. Thus, the portable lavatory 10 is stably and firmly loaded into the freight box 2 of the truck 1. Therefore, the portable lavatory 10 does not move on the bed 3 during the transportation, so that the portable lavatory 10 loaded on the bed 3 is prevented from causing safety hazards during the transportation.

After the truck 1 has arrived at the desired place and the portable lavatory 10 is unloaded from the freight box 2 of the truck 1, separate stairs are installed around the lavatory 10 at a position in front of the door 13 as shown in FIGS. 4*a* and 4*b*, thus allowing people to use the toilet, the washbowl, etc. provided in the lavatory facility unit 11.

In the portable lavatory 10, the variable tank 40 is provided in the junction part between the fresh water tank 20 and the foul watertank 30 of the tank unit 12 as shown in FIGS. 3*a* to 3*c*. Thus, when fresh water is fed into the fresh water tank 20 while the foul water tank 30 is empty, the variable tank 40 is moved toward the foul water tank 30 due to the pressure of the fresh water fed into the fresh water tank 20, thereby defining a subsidiary fresh water tank 20-1 in the foul water tank 30 as shown in FIG. 3*a* Therefore, the fresh water can be contained in both the main fresh water tank 20 and the subsidiary fresh water tank 20-1 formed by the variable tank 40, so that a large quantity of fresh water is contained in the tank unit 12.

When persons use the toilet, the washbowl, etc. provided in the lavatory facility unit 11 after the fresh water is newly contained in both the main fresh water tank 20 and the subsidiary fresh water tank 20-1 formed by the variable tank 40, the fresh water of the main and subsidiary fresh water tanks 20 and 20-1 is gradually consumed to reduce the water level in the tanks 20 and 20-1. In the above state, the amount of foul water generated from the toilet, the washbowl, etc. provided in the lavatory facility unit 11 and stored in the foul water tank 30 is gradually increased.

In the meantime, when a large part of the fresh water contained in the main and subsidiary fresh water tanks 20 and 20-1 has been remarkably consumed while the amount of foul water contained in the foul water tank 30 has been increased, the variable tank 40 is moved toward the fresh water tank 20 due to the pressure of the foul water stored in the foul water tank 30. Thus, a subsidiary foul water tank 30-1 is defined in the fresh water tank 20 as shown in FIG. 3*b*. Therefore, the foul water can be contained in both the main foul water tank 30 and the subsidiary foul water tank 30-1 formed by the variable tank 40, so that a large quantity of foul water is contained in the tank unit 12. In the above state, the capacity of the fresh water tank 20 is reduced in inverse proportion to the increase in the capacity of the subsidiary foul water tank 30-1.

As described above, in the portable lavatory 10 of the present invention, the variable tank 40 is provided in the junction part between the fresh water tank 20 and the foul water tank 30 of the tank unit 12. The variable tank 40 is moved toward the fresh water tank 20 or the foul water tank 30 in inverse proportion to the amounts of fresh water and foul water, thus increasing the capacity of the fresh water tank 20 or the foul water tank 30 of the tank unit 12. Therefore, the portable lavatory 10 of the present invention maximizes the special efficiency of the tank unit 12 even though the tank unit 12 has a fixed capacity.

INDUSTRIAL APPLICABILITY

As described above, the present invention provides a portable lavatory, which is easily loaded into a freight box of a truck. The portable lavatory is constructed to provide a step around a lower end of a lavatory facility unit and define a space around an outer surface of a tank unit. Thus, the portable lavatory is easily and stably loaded into the freight box of a truck such that the tank unit is inserted into the freight box while the lower end of the lavatory facility unit is seated along the upper ends of both side gates and a tailgate of the freight box. Furthermore, a variable tank is provided in a junction part between a fresh water tank and a foul water tank of the tank unit. Thus, when water is supplied into the fresh water tank, the variable tank moves toward the foul water tank to increase the capacity of the fresh water tank and allows the fresh water tank to contain a large quantity of water therein. In the meantime, as the water of the fresh water tank is gradually consumed and foul water is generated from the lavatory facility unit, the variable tank gradually moves toward the fresh water tank to gradually increase the capacity of the foul water tank and allow the foul water tank to contain a large quantity of foul water. Thus, the portable lavatory is used for a lengthy period after every filling of water in the fresh water tank. Because the portable lavatory is loaded into the freight box of the truck such that the tank unit is inserted into the freight box while the lower end of the lavatory facility unit is seated along the upper ends of the side gates and the tailgate of the freight box, the portable lavatory is maintained in a stable, film and safe loaded state in the freight box without being fastened to the truck using a rope.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A portable lavatory, comprising:

a lavatory facility unit having sidewalls and a lower end which define an interior chamber, said interior chamber equipped therein with a toilet and a washbowl, said lavatory facility unit having a door on a sidewall of said sidewalls thereof; and a tank unit integrated with the lower end of the lavatory facility unit and protruded downwardly therefrom to constitute a lower part of the portable lavatory, the tank unit being constructed such that widths and lengths thereof are shorter than those of the lavatory facility unit by predetermined distances, thus providing a step around the lower end of the lavatory facility unit and defining a space around an outer surface of the tank unit the tank unit comprising:

a fresh water tank and a foul water tank each comprising a tank body which is opened at an end thereof and is tapered at the open end thereof to define a tapered part, with a flange provided around the open end of the tapered part, the fresh water tank and the foul water tank being fastened to each other at the flanges thereof facing each other, thus being integrated into a single structure while achieving a predetermined sealing effect at a junction part between the flanges; and a variable tank provided in the junction part between the flanges such that the variable tank is interposed between the flanges to provide the predetermined sealing effect at the junction part.

2. The portable lavatory according to claim 1, wherein the flanges of the fresh water tank and the foul water tank are fastened together along with both an edge of the variable tank placed between the flanges and two sealing plates respectively interposed between both sides of the edge of the variable tank and the flanges, using nuts and bolts arranged along the flanges at regular intervals, so that the predetermined sealing effect is provided at the junction part between the flanges.

* * * * *